United States Patent [19]

Fehrenbacher

[11] Patent Number: 4,482,260

[45] Date of Patent: Nov. 13, 1984

[54] ELECTROMECHANICAL CLOCK

[75] Inventor: Wolfgang Fehrenbacher, St. Georgen, Fed. Rep. of Germany

[73] Assignee: Kieninger & Obergfell, St. Georgen, Fed. Rep. of Germany

[21] Appl. No.: 396,753

[22] Filed: Jul. 9, 1982

[51] Int. Cl.[3] ..... G04B 17/02; G04B 17/10

[52] U.S. Cl. ..... 368/180; 368/272

[58] Field of Search ..... 368/76, 165–167, 368/179–181, 272, 273

[56] References Cited

U.S. PATENT DOCUMENTS

| | | | |
|---|---|---|---|
| 3,802,181 | 4/1974 | Marquis | 368/165 |
| 4,050,236 | 9/1977 | Jauch | 368/181 |
| 4,241,437 | 12/1980 | Ashida | 368/165 |
| 4,308,606 | 12/1981 | Fehrenbacher | 368/165 |

*Primary Examiner*—Bernard Roskoski

*Attorney, Agent, or Firm*—Karl F. Ross; Herbert Dubno

[57] ABSTRACT

A timepiece, with a clockwork driven by a stepping motor, has a clockwork-supporting structure with front and rear uprights, generally of hourglass shape, each constituted by a pair of mirror-symmetrical coplanar strips defining its contour, the front upright being framed by an annular dial swept by the minute and hour hands; the gears of the clockwork are visible from all sides. The supporting structure with the dial is mounted on a platform carried by two columns above a base which contains the motor, its power supply and a tone generator controlled by the clockwork to emit acoustic time signals on the hour and possibly also on the half and quarter hours; a torsion pendulum without time-keeping function is suspended between the columns. Most of the shafts of the clockwork lie in a vertical plane of symmetry also containing the axis of the nested hour, minute and seconds shafts disposed at the center of the dial ring. An ancillary shaft offset from that plane has a pinion in mesh with a gear included in the step-down transmission between the minute and hour shafts so as to rotate in step with the minute hand at one revolution per hour; this ancillary shaft carries a resetting knob and two cam disks, one of them controlling a switch for the periodic actuation of the tone generator while the other causes a resynchronization of that tone generator every 12 hours. The resetting knob is provided with a one-way coupling to prevent reverse rotation of the control cams; the seconds shaft carries an impeller for the torsion pendulum.

33 Claims, 15 Drawing Figures

ELECTROMECHANICAL CLOCK

FIELD OF THE INVENTION

My present invention relates to an electromechanical clock with a motor-driven clockwork and, preferably, with a torsion pendulum which is provided essentially for ornamental reasons and has no time-keeping function but is kept in motion by the clockwork.

BACKGROUND OF THE INVENTION

A timepiece of this character has been described, for example, in my prior U.S. Pat. Nos. 3,990,226 and 4,308,606. Such timepieces, sometimes referred to as anniversary clocks, generally have an upright clockwork-supporting structure in which the several gear shafts—including the coaxial hour and minute shafts as well as possibly a seconds shaft—of the clockwork are horizontally journaled.

Customers often prefer timepieces of this nature whose supporting structure is apertured so that a user may observe the motion of the clockwork and the interplay of its gears. This is esthetically satisfactory but may cause some inconvenience when the timepiece is to be equipped with ancillary mechanical devices such as the aforementioned torsion pendulum or a linkage designed to trigger the emission of an acoustic signal by a sound generator in the base of the structure upon attainment of a particular clockwork position.

OBJECTS OF THE INVENTION

My present invention aims at providing a timepiece of the general character referred to which is of compact construction and virtually unaffected by ancillary devices with which the timepiece may be equipped.

A more particular object of my invention is to provide means in such a clockwork for unobtrusively suspending the torsion pendulum from its supporting structure and operatively coupling that pendulum with the clockwork.

Another more specific object of my invention is to provide simple and unobtrusive means in such a timepiece for mechanically linking one or more circuit-closing switches, disposed at the bottom of its supporting structure, with actuating elements of the clockwork whose position determines the time for the emission of an acoustic signal by an associated tone generator.

A further object, allied with the preceding one, is to provide means for facilitating a synchronization or resynchronization of such a tone generator with the setting of the clockwork, as where an acoustic time signal is to be generated on the full hour and possibly at half-hour or quarter-hour intervals.

Still another object of my invention is to provide a simple and efficient construction for the aforementioned circuit-closing switches.

SUMMARY OF THE INVENTION

My present invention is applicable to any timepiece comprising a clockwork of the usual type, driven by a stepping motor, which includes a gear train with a plurality of cascaded step-down stages mounted on a supporting structure, a horizontal minute shaft traversed by a seconds shaft and surrounded by an hour shaft all coaxially journaled in that structure, and a dial on the supporting structure swept by a minute hand on the minute shaft and an hour hand on the hour shaft, the seconds shaft being coupled with a seconds hand and/or with some other visibly moving member such as the aforementioned torsion pendulum. Pursuant to my present improvement, the supporting structure comprises a front upright and a rear upright which are parallel to each other and bracket the gear train of the clockwork therebetween, the stepping motor being disposed at the bottom of the structure and having a drive shaft in a vertical plane including the common axis of the minute, hour and seconds shafts. The gear train includes central gear means on a central shaft below that axis, first intermediate gear means on a first intermediate shaft coupling the central gear means with a minute gear on the minute shaft, a second intermediate gear means on a second intermediate shaft coupling the central gear means with a second gear on the seconds shaft, and further gear means on an axle forming part of a final step-down stage coupling the minute gear with an hour gear on the hour shaft, this axle lying above the coaxial shafts in the vertical plane of their common axis. The first and second intermediate shafts are laterally offset from that vertical plane on opposite sides thereof so as to provide a generally balanced assembly.

When the timepiece is provided with a torsion pendulum, the supporting structure will be mounted on a platform carried by one or more pairs of columns above a base, with the body of the pendulum suspended by an elongate element from the top of the structure and disposed between these columns. A lateral vane on the elongate element coacts with an impeller which is frictionally mounted on the seconds shaft, preferably as described in my aforementioned U.S. Pat. No. 4,308,606. In that case the rear upright of the supporting structure may be provided with a rearwardly bent bifurcate bracket whose prongs support a cup-shaped guide sleeve; the upper end of the elongate element, lying in the vertical plane of the common shaft axis, extends from below into that sleeve for tensioning by a coil spring, again as known per se from my last-mentioned prior U.S. patent. The bracket, advantageously, has a resilient tongue rising between its prongs and bearing upon the top of the guide sleeve.

Pursuant to another advantageous feature of my present invention, the further gear means of the final step-down stage comprises a relatively large gear rigid with a relatively small gear, the former meshing with a pinion on the minute shaft while the latter meshes with the hour gear which preferably is carried on the hour shaft forwardly of the front upright. An ancillary shaft mounted on the supporting structure parallel to and laterally offset from the common axis carries an ancillary gear coupled to the further gear means for rotary entrainment at the rate of one revolution per hour, the munute gear being frictionally mounted on the minute shaft whereby the minute and hour shafts with their clock hands can be adjusted independently of the position of that gear by manually operable resetting means on the ancillary shaft. The latter shaft, in accordance with a further feature of my present invention, carries cam means controlling switch means for closing a signaling circuit at least once per hour, a sound generator connected to that circuit emitting an acoustic time signal in response to such closure by the switch means.

With the arrangement last described, the switch means may comprise one or two actuators extending along the rear upright of the supporting structure to the bottom thereof and controlled by the respective disks constituting the associated cam means; a housing contains contact means displaceable by the actuator or actuators in predetermined angular positions of the ancillary shaft. Each cam disk may have at least one eccentric dwell terminating in a steep flank, the corresponding actuator comprising a pusher member provided with a foot which rests on a leaf spring forming part of the corresponding contact means and which is biased upward by that leaf spring whereby a cam follower on an upper end of the pusher is urged against the periphery of the disk. Advantageously, the pusher or pushers are closely juxtaposed with respective lateral edges of the rear upright so as to be concealed from the view of an observer looking at the front of the timepiece; these lateral edges may have a curvilinear shape and may be formed from strips bounding large apertures in the supporting structure through which the clockwork can be viewed, the front upright being encircled by the preferably annular dial.

Particularly with cam disks having steep flanks, a reverse rotation of the ancillary shaft by the manual resetting means may have a destructive effect. Thus, still another feature of my invention resides in the provision of a one-way coupling between the ancillary shaft and the resetting means for preventing a reverse rotation of the cam means.

The presence of a second actuator and switch enables an automatic, periodic resynchronization of the sound generator with the clock hands if they have gone out of step for any reason. This also facilitates an initial synchronization which, in the present system, could be performed only during a specified one-hour interval in any 12-hour period.

The housing containing the contact means preferably consists of nonconductive—e.g. polymeric—material which, in the case of two switches controlled by respective pushers, will be subdivided into two adjacent compartments accommodating these switches. Each switch preferably comprises a leaf spring having one extremity secured to a housing wall by a binding post, the other extremity of that leaf spring being engageable with a stationary blade in the housing when displaced from its normal position by the associated pusher traversing an adjoining aperture in the housing wall referred to. The binding post and the blade form terminals of the signaling circuit to be closed by the switch.

BRIEF DESCRIPTION OF THE DRAWING

The above and other features of my invention will now be described in detail with reference to the accompanying drawing in which.

SPECIFIC DESCRIPTION

Figure 1:
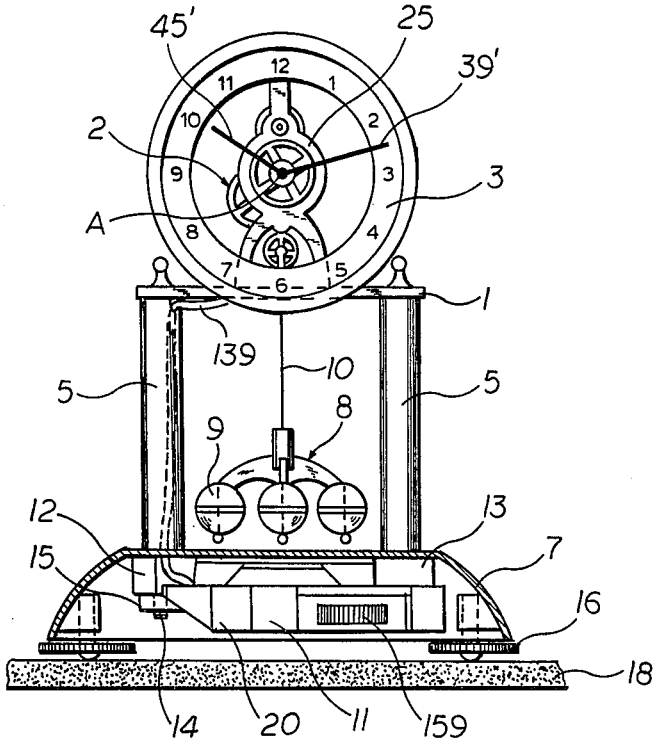
FIG. 1 is a front-elevational view of an anniversay clock embodying my present invention.
Figure 2:
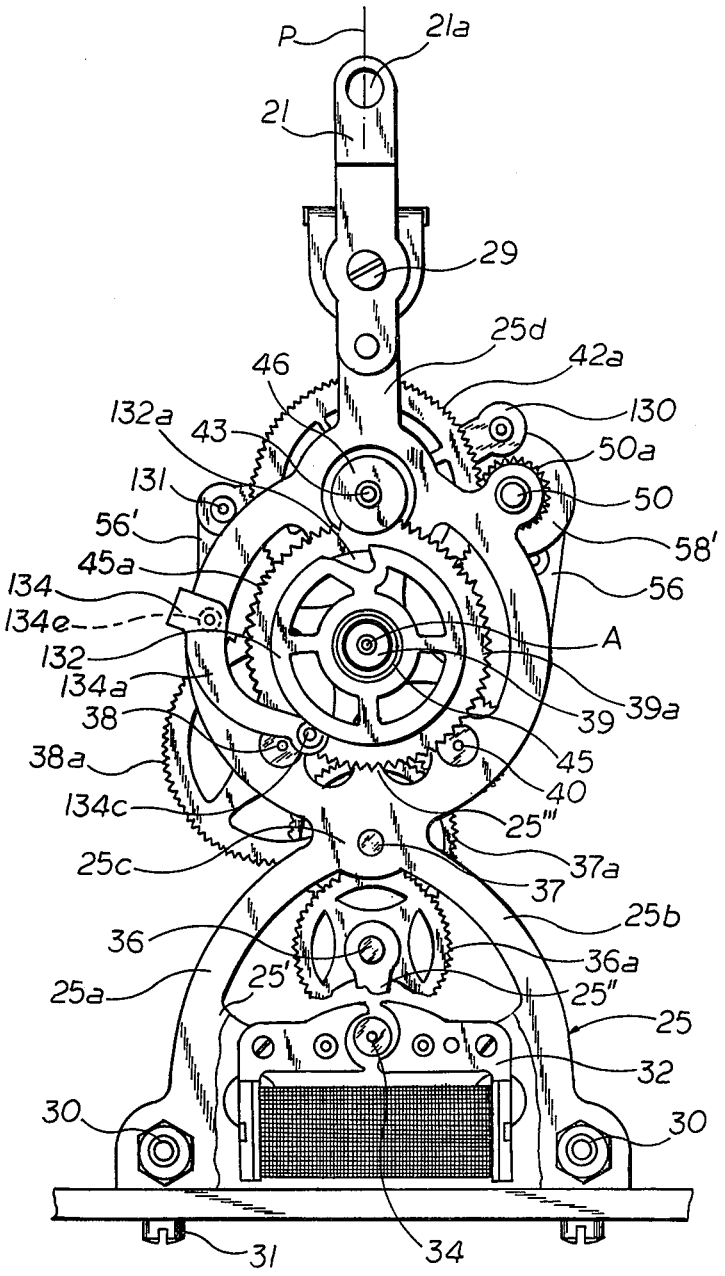
FIG. 2 is a front-elevational view, drawn to a larger scale, of a clockwork-supporting structure forming part of the clock shown in FIG. 1.
Figure 3:
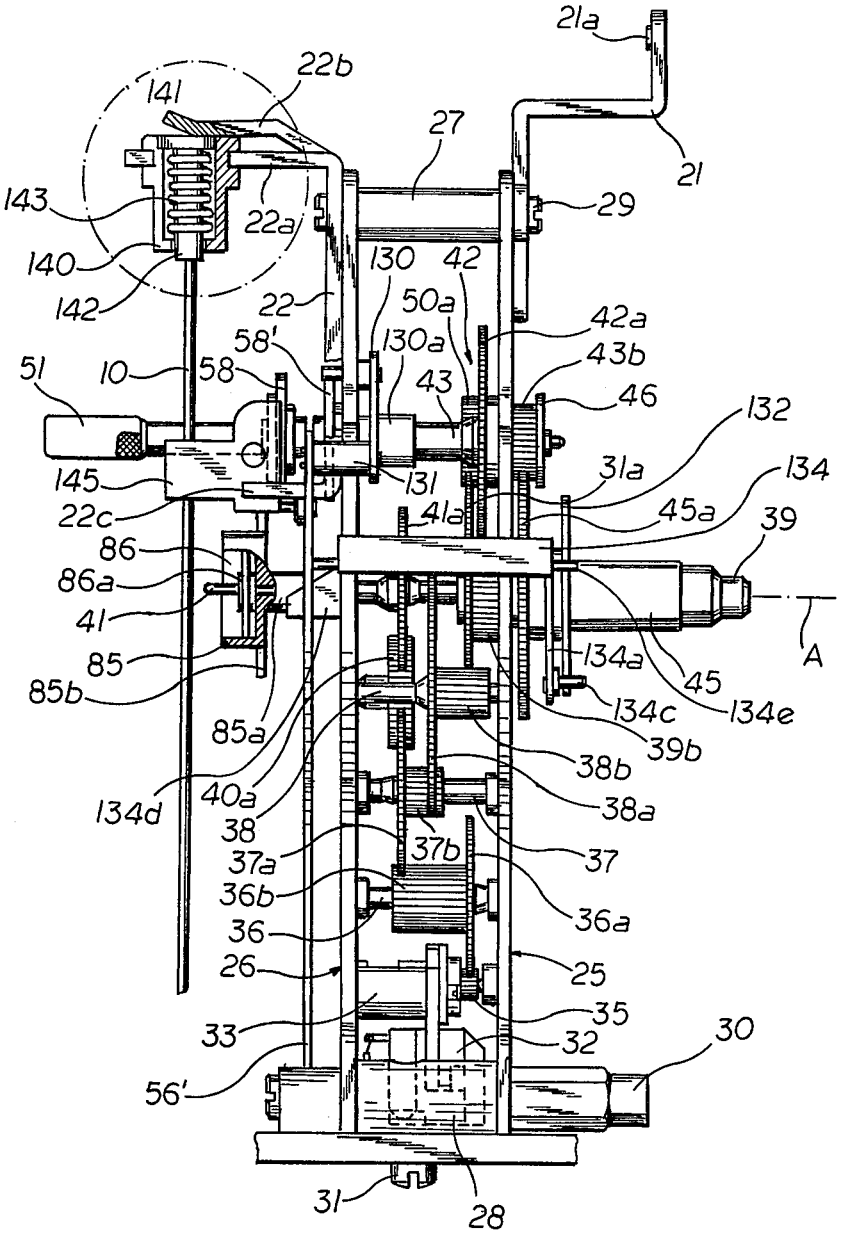
FIG. 3 is a side-elevational view as seen from the left in FIG. 2.
Figure 4:
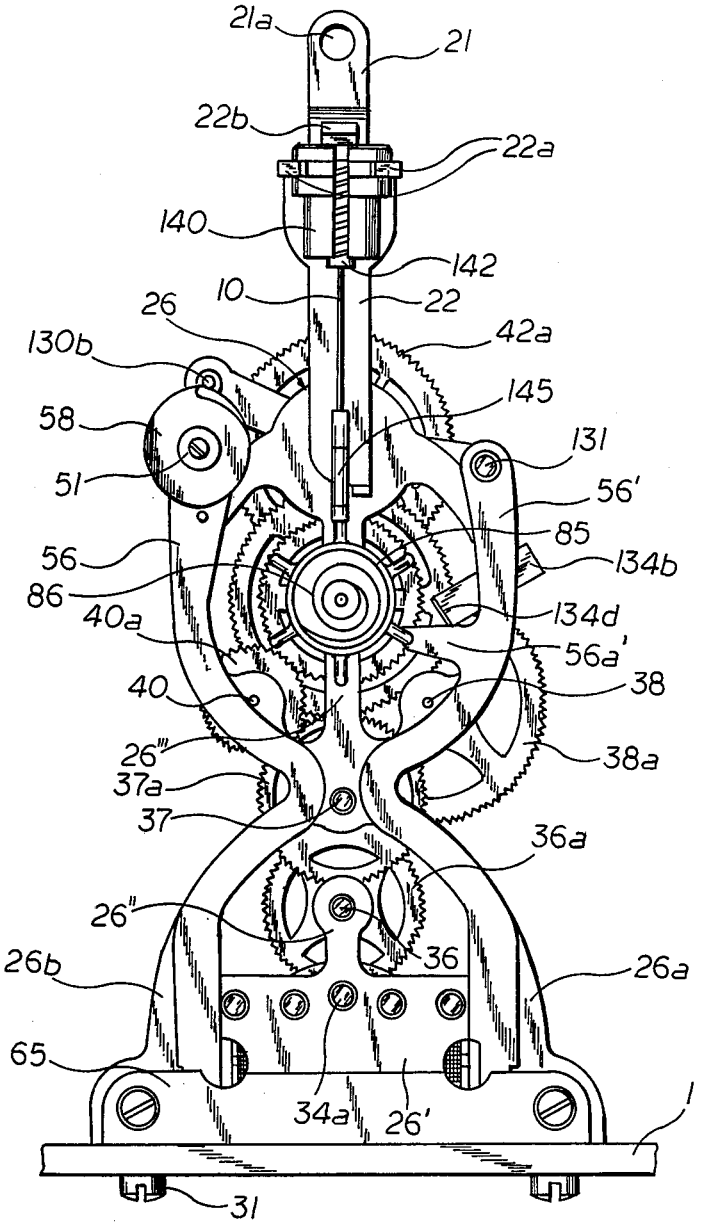
FIG. 4 is a view similar to FIG. 2 but showing a rear-elevational view of the supporting structure.

The timepiece shown in FIG. 1 comprises a mounting plate 1 on which a clockwork 2 is supported by a structure essentially consisting of a front upright 25 and a virtually identical rear upright 26 seen in FIGS. 3 and 4. Upright 25 is framed with bilateral clearance by an angular dial 3 centered on an axis A. The transversely spaced uprights 25, 26 are of skeletal configuration each formed by a pair of flat, coplanar edge strips 25*a*, 25*b* (FIG. 2) or 26*a*, 26*b* (FIG. 4). These edge strips are curvilinear and generally correspond to the contour of an hourglass with a waist 25*c* (as indicated in FIG. 2 for the front upright 25) and with its upper part centered on axis A, that upper part being further extended by a central strip 25*d* as likewise indicated in FIG. 2 for upright 25. The two coextensive pairs of mirror-symmetrical strips 25*a*, 25*b* and 26*a*, 26*b* are otherwise separated by large window apertures whereby clockwork 2 is visible from all sides. The two uprights 25, 26 and the dial 3 are interconnected by several fasteners including screws 29, 30 and spacing sleeves 27, 28. The dial is further attached to the top of upright 25 by a bracket 21 with the aid of a nonillustrated screw traversing a hole 21*a* thereof.

The above-described skeletal supporting structure is also the subject matter of commonly owned U.S. design-patent application Ser. No. 364,657 filed by me jointly with three others on Apr. 2, 1982.

As further shown in FIG. 1, mounting plate 1 is supported by two columns 5 rising from a bell-shaped base 7 which has four legs resting on a tabletop 18, the height of these legs being individually adjustable by knurled screws 16. A pendulum 8 without time-keeping function has a weighted body 9 suspended above base 7, between columns 5, by a torsion spring 10 which is anchored to the rear upright 26 and impelled by the clockwork 2 in a manner more fully described hereinafter. Torsion pendulum 8 is similar to that disclosed in my prior U.S. Pat. No. 4,308,606.

A sound-generating module 11 within base 7 has extensions 12, 13 secured to columns 5 by means of bolts 14 engaged by nuts 15. A casing 20 attached to module 11 contains a power source in the form of one or more batteries along with a miniature loudspeaker. The module is also provided with a manual synchronizing switch 159 whose function, together with the structure of that module, will be described hereinafter with reference to FIG. 15. Retaining screws 31, shown in FIGS. 2–4, serve to secure the structure 25, 26 to mounting plate 1.

Figure 13:
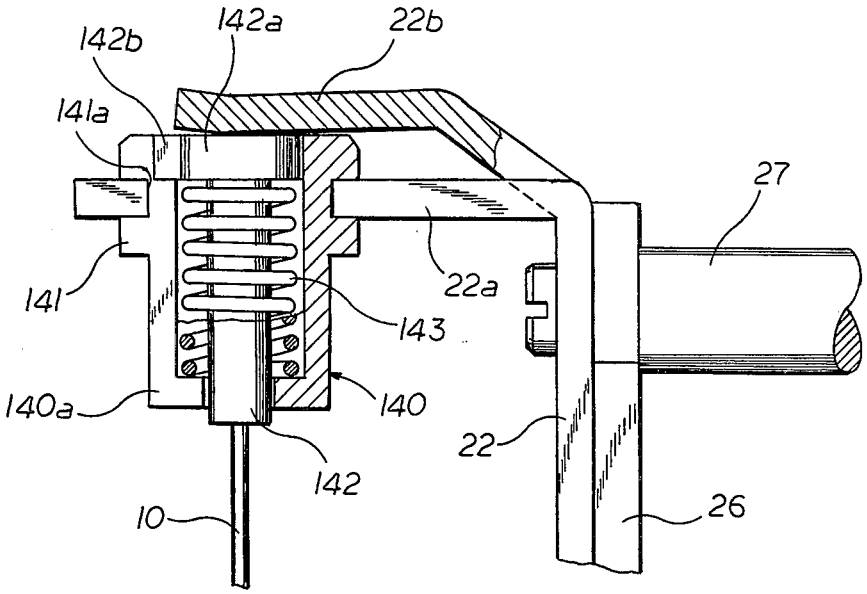
FIG. 13 is a partly sectional detail view, also drawn to a larger scale, of a torsion-spring anchor also shown in FIG. 3.
Figure 14:
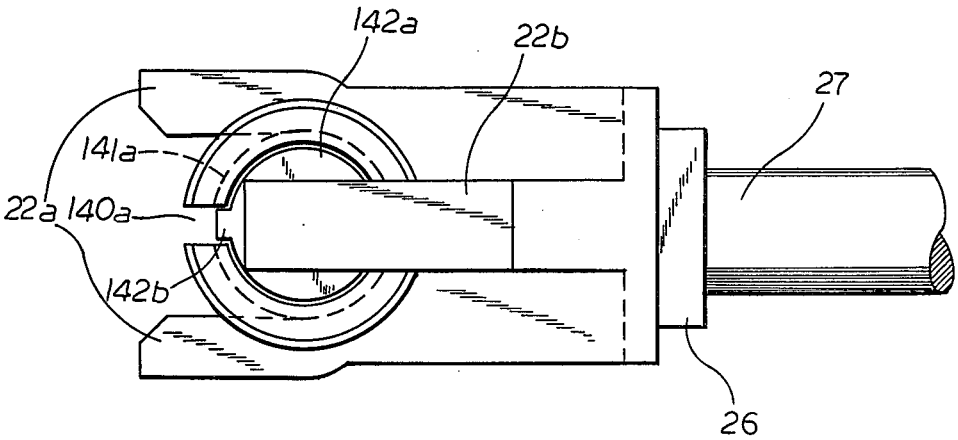
FIG. 14 is a top view of the detail illustrated in FIG. 13.

Another bracket 22, partly broken away in FIG. 3 and shown fully in FIG. 4, is fastened to the top of upright 26 and is rearwardly bent into a bifurcation with two horizontal prongs 22a flanking a resilient tongue 22b integral therewith. A cup-shaped guide sleeve 140 has a rim 141 with a peripheral groove 141a receiving the prongs 22a, as best seen in FIGS. 13 and 14. The upper end of torsion spring 10 is fastened, substantially as disclosed in prior U.S. Pat. No. 4,308,606, to the shank of a bolt whose head 142a, overlain by the resilient tongue 22b, rests on a compression spring 143 which is lodged in sleeve 140 and tensions the elongate element constituted by torsion spring 10 and bolt 142 whose shank traverses that spring. Bolt head 142a has a lug 142b projecting into a longitudinal slot 140a of sleeve 140 to hold the bolt and thus the top of torsion spring 10 against rotation about its axis. Bolt 142 may be injection-molded about the upper end of this torsion spring.

Clockwork 2, as illustrated in FIGS. 2–4, is driven by a stepping motor 32 bolted to upright 26 by way of a spacing sleeve 33. Motor 32 has a rotor 34 with a driving shaft 34a carrying a pinion 35 whose axis lies in a vertical plane of symmetry P of uprights 25, 26 passing through the center of dial 3. Rotor shaft 34a is journaled in a bottom web 25' (partly broken away in FIG. 2) of upright 25 and a coextensive web 26' (FIG. 4) of upright 26, the two webs being provided with upstanding lugs 25'', 26'' forming bearings for a shaft 36 of a first step-down stage of a gear train included in clockwork 2. That first stage comprises a gear 36a on shaft 36 in mesh with pinion 35 and a pinion 36b rigid therewith engaging a central gear 37a on a central shaft 37 which is rigid with a pinion 37b, shaft 37 being journaled at the waist 25c of upright 25 and the corresponding waist of bracket 26. Gears 37a, 37b are assumed to execute a full revolution in 60 seconds; rotor 34 may turn through 180° with each step of motor 32.

Pinion 37b meshes with a gear 38a on a first intermediate shaft 38 which is journaled in two arcuately curved parts of edge strips 25a, 26a centered on axis A. Shaft 38 also carries a pinion 38b, rigid with gear 38a, meshing with a minute gear 39a which is frictionally fitted onto a minute shaft 39 in line with axis A. Minute shaft 39, which is tubular, is coaxially nested in a tubular hour shaft 45 and in turn surrounds a seconds shaft 41. The three coaxial shafts 39, 41 and 45 are supported by central webs 25''', 26''' of uprights 25, 26, with shafts 39 and 45 projecting forward through the web 25''' of front upright 25 while shaft 41 projects backward through the web 26''' of rear upright 26. The free, reduced ends of shafts 39 and 45 respectively support a minute hand 39' and an hour hand 45', shown in FIG. 1 but omitted in other Figures, which sweep the annular dial 3. If desired, shaft 41 could also extend beyond the front end of minute shaft 39 and carry a seconds hand.

A seconds gear 41a keyed to shaft 41 is driven by central gear 37a through a gear 40a, mounted on a second intermediate shaft 40, so as to turn the shaft 41 at the same speed of 1 RPM as gear 37a. The rearwardly projecting end of shaft 41 carries an impeller in the form of a wheel 85 whose hub 85a idles on shaft 41, again as described in my prior U.S. Pat. No. 4,308,606, but which is frictionally entrained by that shaft through the intermediary of a spiral spring 86 that bears upon the inner periphery of wheel 85 and is secured to the shaft through a nave 86a. The wheel has a set of peripheral teeth 85b which intermittently coact with a vane 145 extending laterally from torsion spring 10 when that vane, once in every oscillatory cycle of pendulum body 9 (FIG. 1), abuts a stop 22c formed by the lower end of bracket 22.

The second intermediate shaft 40 is journaled, substantially on the same level as shaft 38, in two arcuately curved parts of edge strips 25b, 26b also centered on axis A. Thus, the two intermediate shafts 38, 40 are laterally offset from central plane P and lie more or less symmetrically on opposite sides thereof. Gear 40a, however, is of considerably smaller diameter than gear 38a.

A pinion 39b, keyed to minute shaft 39 for positive rotary entrainment, is in mesh with a gear 42a idling together with a pinion 42b on a nonrotating axle 43 which is riveted to upright 326 and lies above axis A in vertical plane P. Pinion 42b, which together with gear 42a forms part of a final step-down stage 42, penetrates a circular cutout in front upright 25 and is held in position by a retaining disk 46 secured to the free end of axle 43. An hour gear 45a, keyed to shaft 45 forwardly of upright 25, is in mesh with pinion 43b to make the minute and hour hands 39', 45' (FIG. 1) rotate at the usual speed ratio of 12:1.

Figure 11:
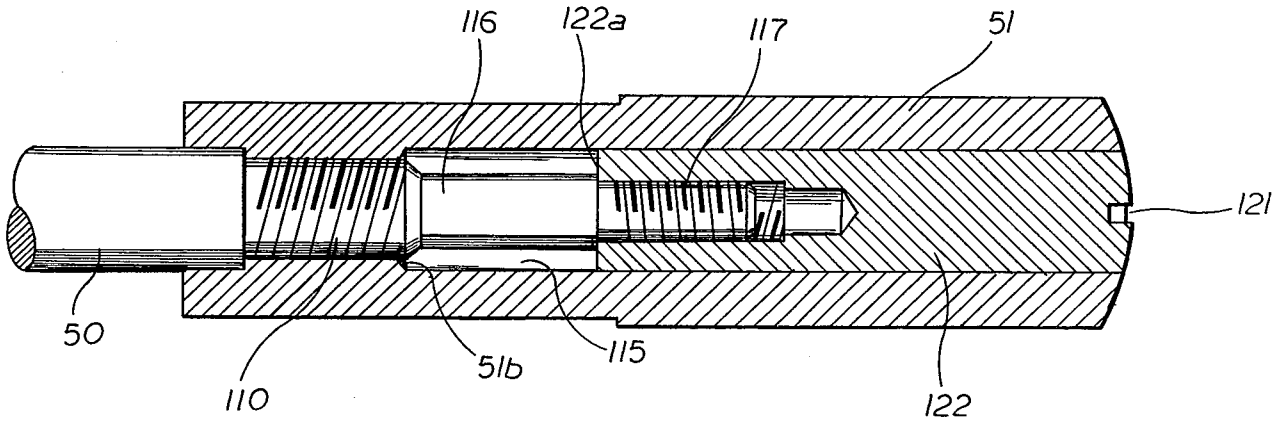
FIG. 11 is an enlarged longitudinal sectional view of a resetting knob seen in FIGS. 3 and 4.
Figure 12:
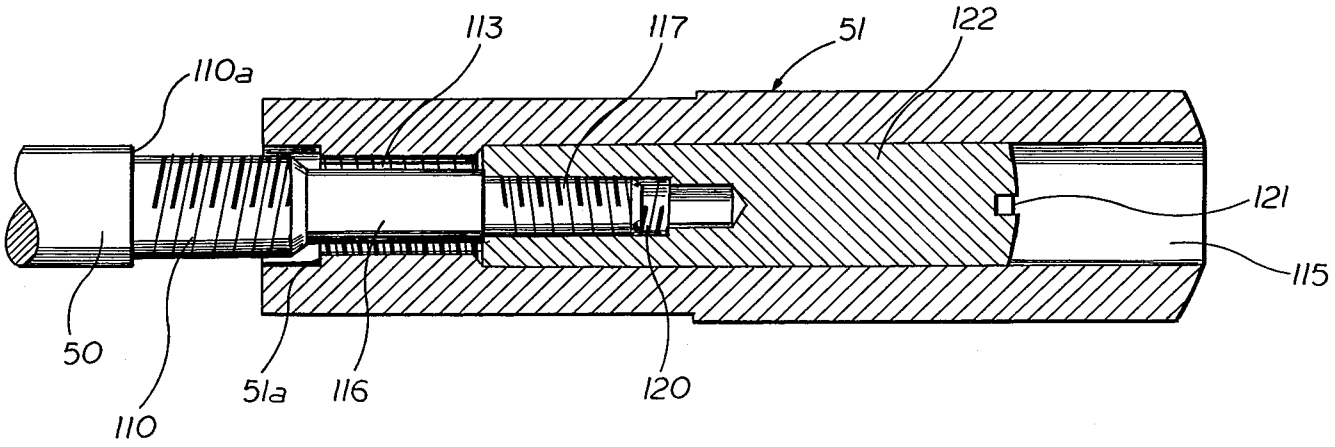
FIG. 12 is a view similar to that of FIG. 11 but showing the resetting knob in an alternate position.

Gear 42a is further in mesh with a considerably smaller gear 50a on an ancillary shaft 50 which is journaled, substantially on the level of axle 43, in lateral protuberances of edge strips 25b, 26b, thus on the same side of plane P as shaft 40 and gears 40a, 40b; this contributes to the balance of the clockwork assembly. Shaft 50 carries a manually operable resetting knob 51, more fully described hereinafter with reference to FIGS. 11 and 12, which allows the position of hands 39' and 45' to be adjusted by rotation of their shafts 39 and 45 independently of the position of minute gear 39a frictionally coupled with shaft 39.

Figure 7:
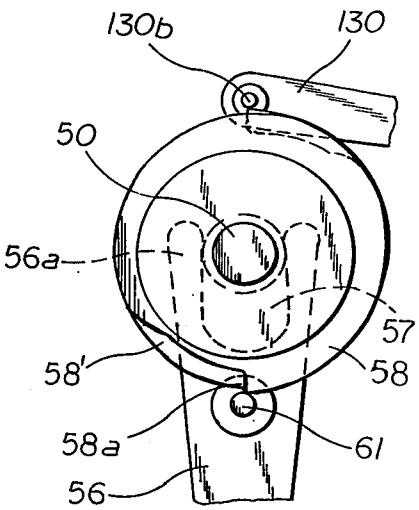
FIG. 7 is a side view of the detail of FIG. 5 as seen from the left.
Figure 5:
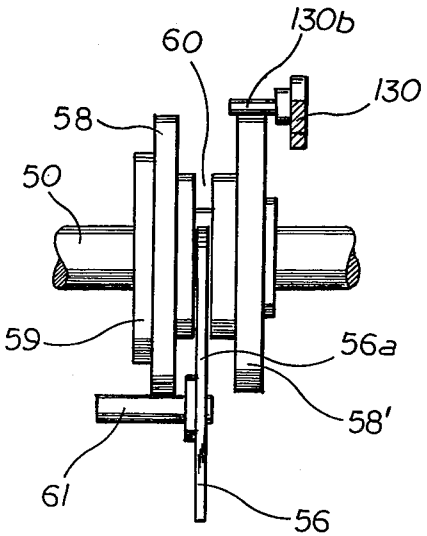
FIG. 5 is an enlarged front-elevational detail view of a pair of cam disks shown in FIG. 3.
Figure 6:
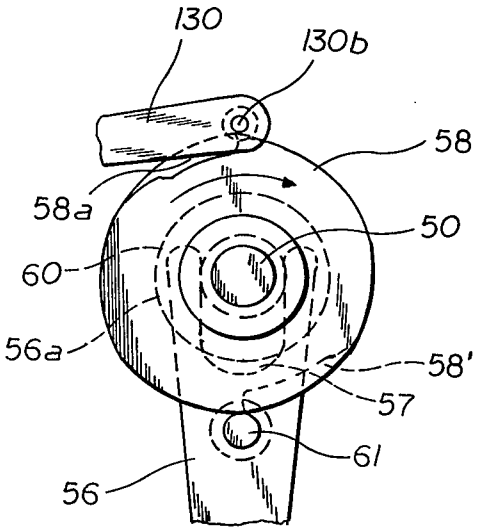
FIG. 6 is a side view of the detail of FIG. 5 as seen from the right.

A pair of cam disks 58 and 58', more fully illustrated in FIGS. 5–7, are fixedly mounted on ancillary shaft 50, rearwardly of upright 26, by means of a common bushing 59. The latter has a peripheral groove 60 straddled by a bifurcate upper end 56a of a pusher member 56, in the form of a flat arm, whose prongs are separated by a slot 57. This slot receives the reduced part of bushing 59 with enough play to let the pusher 56 rise from the position of FIGS. 5–7 in which a cam follower 61 thereof, in the shape of a pin, contacts a large-diameter dwell of cam 58 extending over more than three quarters of its periphery. Such a rise occurs, for reasons to be described, when the pin 61 encounters a steep flank 58a of that dwell in the course of a revolution of shaft 50. A similar cam follower 130b, also designed as a pin, is carried on an extremity of a lever 130 which is fulcrumed on upright 26 by a hub 130a, FIG. 3, an opposite extremity of lever 130 being articulated at 131 to a similar pusher 56' disposed on the other side of plane P. Pin 130b rests on the periphery of cam 58' which has a dwell similar to that of cam 58 terminating in a steep flank 58a'. Shaft 50 and cam disks 58, 58' rotate codirectionally with shafts 39 and 45, i.e. clockwise as viewed in FIGS. 2 and 6.

Figure 8:
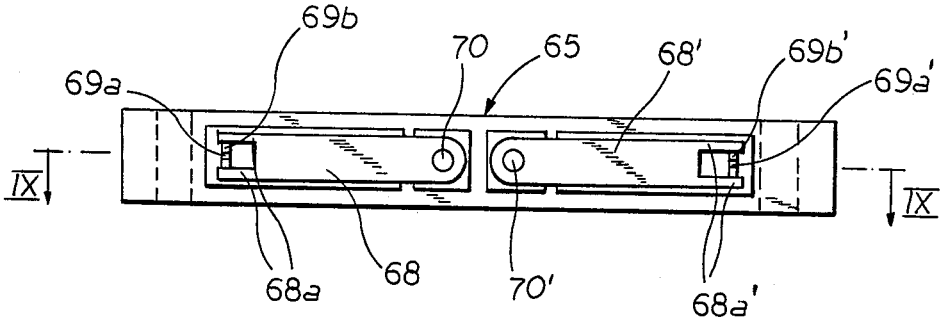
FIG. 8 is a bottom view of a switch housing visible in FIG. 4.
Figure 9:
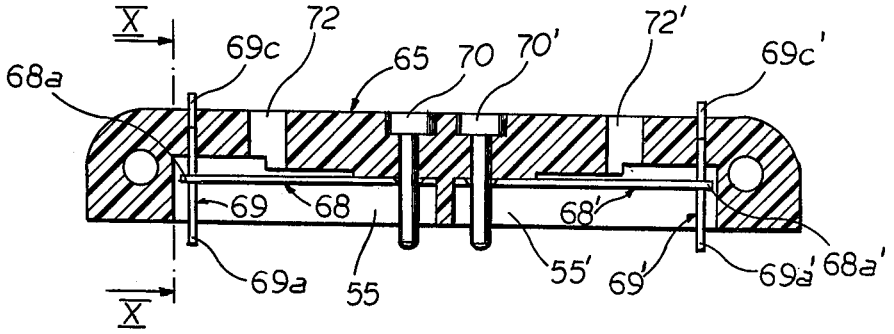
FIG. 9 is a longitudinal sectional view taken on the line IX—IX of FIG. 8.
Figure 10:
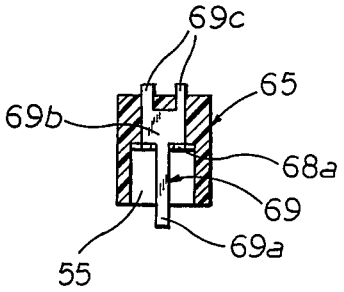
FIG. 10 is a cross-sectional view taken on the line X—X of FIG. 9.

The two pushers 56, 56' respectively controlled by cam disks 58, 58' extend down from the level of axle 43 into an elongate housing 65 of dielectric material resting on mounting plate 1 as seen in FIG. 4. Housing 65, more fully illustrated in FIGS. 8–10, is longitudinally divided into two compartments 55, 55' accommodating respective switches which are normally held open by the respective pushers in their depressed positions. The pushers, not shown in FIGS. 8–10, enter the compartments 55 and 55' through respective apertures 72, 72' which overlie the free ends of a pair of leaf springs 68, 68' whose opposite extremities are fastened to the apertured upper housing wall by binding posts 70, 70' acting as terminal pins. The movable extremities of the cantilevered leaf springs 68 and 68' are bifurcate; their prongs 68*a*, 68*a'* spacedly straddle stems 69*a*, 69*a'* of respective contact blades 69, 69' which, as best seen in FIG. 10, are generally T-shaped with transverse bars 69*b*, 69*b'* projecting slightly from the upper wall of the housing 65 molded therearound. Lugs 69*c*, 69*c'* projecting from the top of the housing may be bent over for more securely holding the blades in position; the lower ends of blades 69 and 69', like those of binding posts 70 and 70', may be soldered to wires of a cable 139 extending behind one of the columns 5 into casing 20 of module 11 as seen in FIG. 1.

FIG. 10 shows the leaf spring 68 in its rest position in which its prongs 68*a* contact the cross-bar 69*b* of the associated blade 69 to close the associated switching circuit as more fully described hereinafter with reference to FIG. 15. Such closure occurs, as will be apparent from FIGS. 5–7, when the cam follower 61 of pusher 56 (see also FIG. 4) drops behind the flank 58*a* of cam 58 shortly after the cams have reached the position illustrated in FIGS. 6 and 7. The other pusher 56' (FIGS. 3 and 4), controlled by cam disk 58' via lever 130, is similarly elevated to close the switching circuit of contacts 68', 69' when the flank 58*a'* of disk 58' passes the cam follower 130*b* which thereupon drops behind it. In the system here particularly contemplated, the closure of contacts 68, 69 by the foot of pusher 56 occurs a few minutes after that of contacts 68', 69' by the foot of pusher 56'. The cam followers 61 and 130*b* are held in contact with the respective disk peripheries by the biasing force of leaf springs 68 and 68'.

As seen in FIG. 4, the two pushers 56, 56' designed as flat arms have substantially the same width as the curvilinear edge strips 26*a*, 26*b* and are largely coextensive therewith, with pusher 56' lying behind strip 26*a* and pusher 56 lying behind strip 26*b*. These pushers, therefore, will be almost invisible to a person observing the timepiece from the front.

For reasons that will become clear hereinafter, the closure of switch 68', 69' should occur only once during a 12-hour cycle so that it is necessary to inhibit the rise of pusher 56' during the intervening 11 revolutions of cam disk 58'. For this purpose the hour shaft 45 carries a cam disk 132 having a single peripheral notch 132*a* engageable by a cam follower 134*c* on an arm 134*a* of a blocking lever 134 which reaches around the uprights 25, 26 and is fulcrumed thereon by a rod 134*e*. The opposite arm 134*b* of lever 134 has an extension 134*d* which overlies an extension 56*a'* of pusher 56' and holds it down as long as cam follower 134*c* engages the large-radius part of cam disk 132 against which it is urged by gravity or, if necessary, by a nonillustrated spring. Notch 132*a* is aligned with cam follower 134*c* only when the hour hand 45'' (FIG. 1) approaches the numeral 2 on dial 3. Pivot rod 134*e* has a reduced end traversing the lever arm 134*a* so as not to shift forward; a rearward shift is prevented by contact of the opposite end of that rod with pusher 56'.

As will be apparent from the cam structure shown in FIGS. 6 and 7, a reverse rotation of shaft 50 (counterclockwise in FIG. 6) by means of knob 51 would be harmful. It is therefore prefer to connect this knob with its shaft 50 through a undirectional coupling as particularly illustrated in FIGS. 11 and 12. Shaft 50, for this purpose, has a reduced part 110 provided with external threads while knob 51 is designed as a cylindrical sleeve with a smaller-diameter zone 113 having female threads complementary to the male threads of part 110. These threads are of left-handed pitch for positively coupling the knob 51 with shaft 50 when a user rotates that knob counterclockwise as seen in the rear view of FIG. 4, this sense of rotation corresponding of course to the one referred to in connection with FIG. 6. In that case an internal shoulder 51*a* of knob 51 comes to rest against an external shoulder 110*a* of shaft 50 to establish the coupled position illustrated in FIG. 11. The threaded sections 110 and 113, however, interfit loosely enough to unthread the knob 51 from the shaft 50 when the knob is rotated in reverse, thereby establishing the decoupled position shown in FIG. 12.

In order to prevent a complete separation of knob 51 from shaft 50, the shaft is formed with a cylindrical link 116 of lesser diameter than part 110 but greater axial length than zone 113, this link serving to connect the shaft with a plug 122 received with a loose fit in a larger-diameter zone 115 of the knob which adjoins the smaller-diameter zone 113 at an internal shoulder 51*b*. A face 122*a* of plug 122 closely confronts the shoulder 51*b* in the position of FIG. 12 and limits the extent to which the knob 51 can be withdrawn from the shaft 50. The connection between the shaft and the plug is made by mating male and female threads 117, 120 whose pitch is right-handed and thus opposite that of the coupling threads of shaft section 110 and sleeve section 113. In contradistinction to the latter threads, the right-handed threads 117 and 120 interengage with a tight fit; the free end of plug 122 is shown provided with a slot 121 facilitating the fastening of the plug to the shaft for its disassembly therefrom in the case of necessity.

Figure 15:
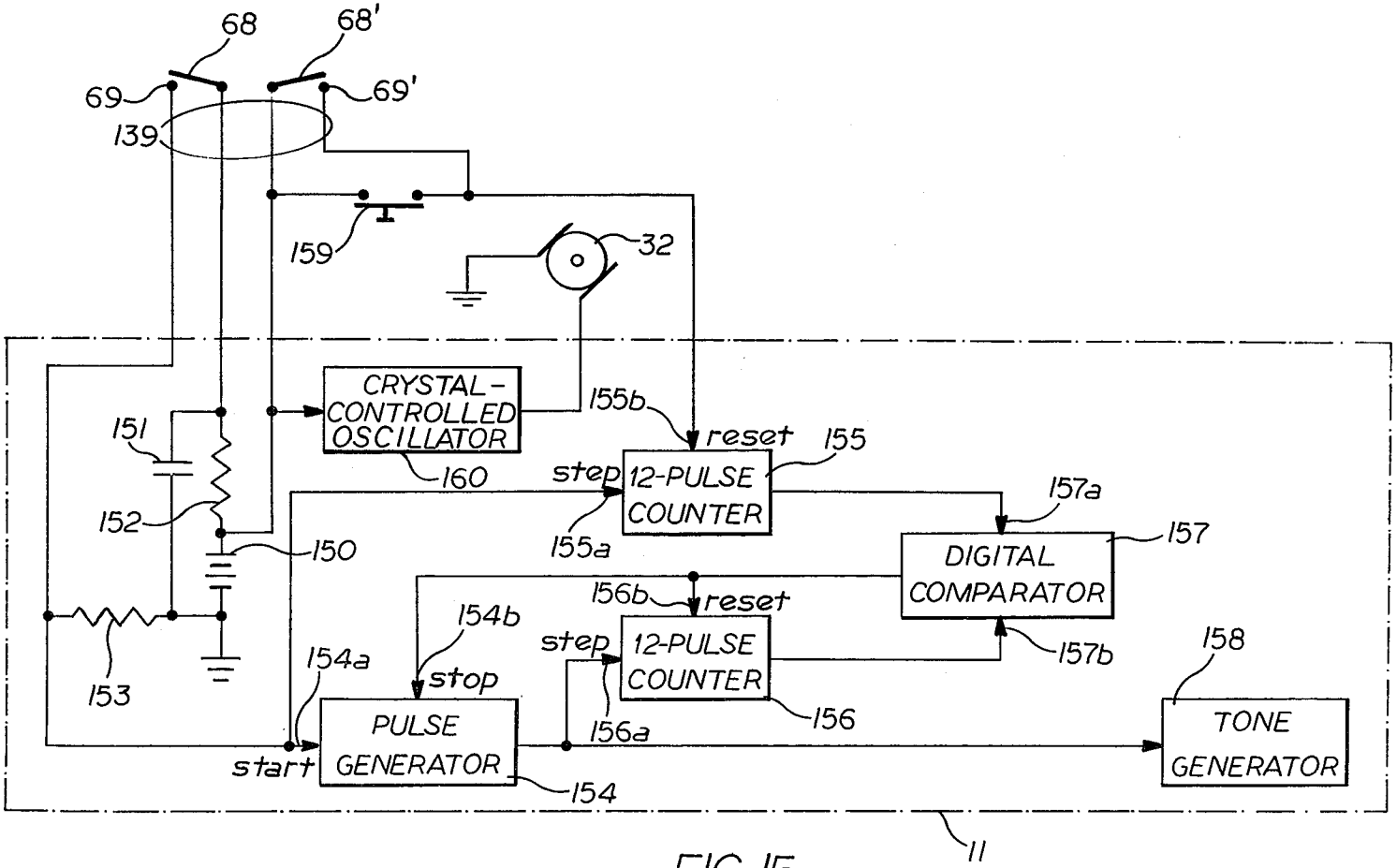
FIG. 15 is a block diagram of a sound-generating circuit included in the clock of FIG. 1.

I shall now described, with reference to FIG. 15, the operation of the sound-generating module 11 (FIG. 1) under the control of cam disks 58 and 58' driven by the clockwork 2. The circuitry of FIG. 15 is not part of my present invention but is being presented for the sake of completeness.

The module shown in FIG. 15 comprises a tone generator 158 which could be of the type available, for example, from Suwa Seikosha Co., Ltd., Tokyo, Japan, under the designation SVM 5530. That particular model is designed to emit the notes of the well-known Westminster chime ("Big Ben") in 15-minute intervals. Such an operation, however, would require the replacement of the single dwell of cam 58 (FIGS. 5–7) by four dwells equispaced about the disk periphery. In the simplified example here more particularly considered, tone generator 158 may strike a gong only on the full hour.

As shown in FIG. 15, tone generator 158 is connected to the output of a pulse generator 154 which has a starting input 154*a* and a stopping input 154*b*. A battery 150, which powers all the components of module 11 including a crystal-controlled oscillator 160 operating the stepping motor 32 of FIGS. 2 and 3, is connected through a relatively large charging resistor 152 across a capacitor 151 which in turn is connected via a relatively small discharging resistor 153 across the contacts 68 and 69 of the switch lodged in compartment 55 of housing 65 (FIGS. 8–10). Starting input 154*a* of pulse generator 154 is connected, in parallel with resistor 153 and with a stepping input 155*a* of a 12-pulse hour counter 155, to contact 69 for energization by the charge of capacitor 151 upon the closure of switch 68, 69; as the grounded resistor 153 prevents any significant recharging of the capacitor during closure of that switch, only a single pulse will be transmitted to inputs 154*a* and 155*a* regardless of the duration of such closure. This pulse immediately advances the counter 155 by one step and triggers generator 154 into the emission of one or more activating pulses delivered to tone generator 158 as well as to a stepping input 156*a* of a 12-pulse strike counter 156. The two counters 155 and 156 work into respective inputs of a digital comparator 157 which energizes the stopping input 154*b* of pulse generator 154 as well as a resetting input 156*b* of strike counter 156 as soon as the reading of the latter counter corresponds to the setting of counter 155. Thus, for example, at 9 o'clock the hour counter 155 will be stepped from its reading of 8 to a reading of 9 whereupon comparator 157 will arrest generator 154 after the emission of nine activating pulses corresponding to as many gong strikes of tone generator 158; the strike counter 156 will be reset to zero at the same time.

When the hour counter 155 has reached its full count of 12, the arrival of a stepping pulse at 1 o'clock will reset it to an initial count of 1 so as to recommence its 12-hour cycle. If, however, a battery change or possibly a malfunction has desynchronized the counter 155 with reference to the setting of the clock hands, a resynchronization will automatically occur with the aid of switch 68', 69' controlled by cam disk 58' (FIGS. 5–7) in accordance with my present invention. These latter contacts, when closed, connect the ungrounded terminal of battery 150 to a resetting input 155*b* of counter 155 to establish the initial count of 1 if its reading at that time should be different; such a resetting should occur before the hour of 2 o'clock, e.g. between 1:50 and 1:55, so that counter 155 will properly advance to a count of 2 on the full hour. Obviously, the closure of contacts 68', 69' will have no effect if synchronism already exists. These contacts, furthermore, are shown connected in parallel with the manual resetting switch 159 illustrated in FIG. 1; as will be apparent, manual synchronization (which would be needed only upon a malfunction of switch 55') should be carried out only between the first and the second hour.

The combination of switches 68, 69 and 68', 69' could also be used for the generation of other periodic signals, e.g. for the start of a 4-hour watch in a sound cycle corresponding to that of ship's bells; see, for example, commonly owned U.S. Pat. No. 4,276,625. In such a case, of course, cam disk 132 will need to have more than one notch.

I claim:

1. In a timepiece comprising a stepping motor, a clockwork driven by said motor including a gear train with a plurality of cascaded step-down stages mounted on a supporting structure, a horizontal minute shaft traversed by a seconds shaft and surrounded by an hour shaft, journaled in said structure, said gear train including a minute gear on said minute shaft, an hour gear on said hour shaft and a seconds gear on said seconds shaft, and a dial on said structure swept by a minute hand on said minute shaft and an hour hand on said hour shaft, the improvement wherein said structure comprises a front upright and a rear upright parallel to each other brack-eting said gear train therebetween, said motor being disposed at the bottom of said structure with a drive shaft in a vertical plane including the axis of said minute, hour and seconds shafts, said gear train including central gear means on a central shaft below said axis, first intermediate gear means on a first intermediate shaft coupling said central gear means with said minute gear, second intermediate gear means on a second intermediate shaft coupling said central gear means with said seconds gear, said first and second intermediate shafts being laterally offset from said vertical plane on opposite sides thereof, further gear means on an axle forming part of a final step-down stage coupling said minute gear with said hour gear, said axle lying in said vertical plane above said axis, and a visibly moving member coupled with said seconds shaft.

2. A timepiece as defined in claim 1 wherein said structure is mounted on a platform supported by a pair of columns above a base, said visibly moving member comprising a torsion pendulum with a body suspended by an elongate element from the top of said structure and disposed between said columns above said base, said elongate element carrying a lateral vane coacting with an impeller frictionally mounted on said seconds shaft.

3. A timepiece as defined in claim 2 wherein said rear upright is provided with a rearwardly bent bifurcate bracket with a pair of prongs supporting a cup-shaped guide sleeve, said elongate element lying in said vertical plane and having an upper end extending from below into said guide sleeve, said upper ends traversing a coil spring seated in said guide sleeve while being anchored under tension to the top of said coil spring.

4. A timepiece as defined in claim 3 wherein said bracket is provided with a resilient tongue rising between saidprongs and bearing upon the top of said guide sleeve.

5. A timepiece as defined in claim 3 or 4 wherein said bracket has a downward extension forming an abutment for said vane above the level of said impeller.

6. A timepiece as defined in claim 5 wherein said downward extension is secured to said rear upright by a connection with said axle.

7. A timepiece as defined in claim 1 wherein said further gear means comprises a relatively large gear in mesh with a pinion on said minute shaft and a relatively small gear rigid with said relatively large gear in mesh with said hour gear.

8. A timepiece as defined in claim 7, further comprising an ancillary shaft mounted on said structure parallel to and laterally offset from said axle and an ancillary gear on said ancillary shaft coupled to said further gear means for rotary entrainment at a rate of one revolution per hour, said minute gear being frictionally mounted on said minute shaft, said ancillary shaft being provided with manually operable resetting means for changing the positions of said minute and hour shafts and hands independently of the position of said minute gear.

9. A timepiece as defined in claim 7 and 8 wherein said hour gear is carried on said hour shaft forwardly of said front upright, said relatively small gear penetrating said front upright and engaging said hour gear outside said structure.

10. A timepiece as defined in claim 8, further comprising cam means on said ancillary shaft, switch means controlled by said cam means for closing a signaling circuit at least once per hour, and sound-generating means connected to said signaling circuit for emitting an acoustic time signal in response to closure of said circuit by said switch means.

11. A timepiece as defined in claim 10 wherein said switch means comprises actuating means means extending along said rear upright to the bottom of said structure, a housing at said bottom penetrated by said actuating means, and contact means in said housing displaceable by said actuating means in a predetermined angular position of said cam means.

12. A timepiece as defined in claim 11 wherein said cam means comprises at least one disk with an eccentric dwell terminating in a steep flank, said actuating means comprising at least one pusher member provided with a foot resting on a leaf spring forming part of said contact means, said leaf spring urging a cam follower on an upper end of said pusher member against the periphery of said disk.

13. A timepiece as defined in claim 12 wherein said rear upright comprises a pair of curvilinear lateral edge strips, said pusher member being closely juxtaposed and largely coextensive with one of said edge strips.

14. A timepiece as defined in claim 12 wherein the upper end of said pusher member has a guide slot traversed by said ancillary shaft.

15. A timepiece as defined in claim 12, 13 or 14 wherein said housing consists of nonconductive material, said leaf spring having one extremity secured to said housing by a binding post forming a first terminal and having another extremity engageable with a stationary blade in said housing forming a second terminal, said other extremity underlying an aperture in said housing receiving the foot of said pusher member.

16. A timepiece as defined in claim 15 wherein said other extremity is bifurcate and straddles said blade with clearance, said blade being generally T-shaped with a transverse bar engageable by said bifurcate extremity in a depressed position thereof.

17. A timepiece as defined in claim 10 wherein said cam mean comprises a first cam and a second cam, said switch means comprising a first switch controlled by said first cam for closing said signaling circuit on the full hour as indicated by said minute and hour hands, said switch means further comprising a second switch controlled by said second cam for emitting a synchronization signal to said sound-generating means in advance of the emission of an acoustic time signal thereby.

18. A timepiece as defined in claim 17, further comprising blocking means on said hour shaft coacting with said second switch for enabling the emission of said synchronization signal in only a limited number of one-hour intervals in the course of a revolution of said hour shaft.

19. A timepiece as defined in claim 18 wherein said blocking means comprises a cam disk with a single eccentric formation enabling the emission of said synchronization signal only once in a 12-hour period.

20. A timepiece as defined in claim 17, 18 or 19 wherein said first and second switches include respective pushers extending along said rear upright to the bottom of said structure, a housing at said bottom penetrated by said pushers, and contacts in said housing displaceable by said pushers in respective angular position of said cams.

21. A timepiece as defined in claim 20 wherein said pushers are disposed on opposite sides of said vertical plane.

22. A timepiece as defined in claim 21 wherein one of said pushers, lying on the side of said ancillary shaft, directly engages one of said cams while the other of said pushers, lying on the side opposite said ancillary shaft, is coupled with the other of said cams through the intermediary of an arm pivoted on said axle.

23. A timepiece as defined in claim 22 wherein said rear upright comprises a pair of curvilinear lateral edge strips, said pushers being closely juxtaposed and largely coextensive with said edge strips.

24. A timepiece as defined in claim 10, 11, 12, 13, 14, 17, 18 or 19 wherein said manually operable resetting means is linked with said ancillary shaft by a one-way coupling preventing reverse rotation of said cam means.

25. A timepiece as defined in claim 24 wherein said resetting means comprises a sleeve with internal threads surrounding a reduced part of said ancillary shaft provided with complementary external threads, said internal and external threads establishing a position of positive interengagement of said sleeve and said ancillary shaft upon rotation of said sleeve in a direction conforming to the motion imparted to said ancillary shaft by said clockwork, said threads mating with a loose enough fit to prevent a rotary entrainment of said ancillary shaft by said sleeve in the opposite direction.

26. A timepiece as defined in claim 25 wherein said sleeve has a bore with a smaller-diameter zone bearing said internal threads and abutting an external shoulder of said ancillary shaft in said position of positive interengagement, said bore further having a larger-diameter zone separated from said smaller-diameter zone by an internal shoulder on the side opposite said external shoulder, further comprising a plug in said larger-diameter zone attached to said reduced part of said ancillary shaft by a link of lesser diameter than said reduced part and of greater axial length than said smaller-diameter zone, said plug coming to rest against said internal shoulder upon complete disengagement of said internal and external threads from each other for preventing a separation of said sleeve from said ancillary shaft.

27. A timepiece as defined in claim 26 wherein said plug is connected with said link by male and female threads having a pitch opposite that of said internal and external threads.

28. A timepiece as defined in claim 1, 2, 3, 4, 7, 8, 10, 11, 12, 13, 14, 17, 18 or 19 wherein said uprights are transversely separated and have large apertures bisected by said vertical plane and bounded by edge strips enabling the viewing of said clockwork form all sides, said dial being a frame surrounding said front upright with bilateral clearance.

29. A timepiece as defined in claim 28 wherein said frame is circular and centered on said axis.

30. A timepiece as defined in claim 28 wherein said edge strips arcuately curve around said axis and merge with each other generally in hourglass fashion at a waist below said axis, said central shaft being supported by said uprights at said waist.

31. In a timepiece comprising a motor-driven clockwork, a sound generator, and switch means controlled by said clockwork for closing an operating circuit for said sound generator in a predetermined position of said clockwork, the improvement wherein said switch means comprises a housing of nonconductive material, metallic leaf spring in said housing having one extremity secured to a binding post fixedly positioned therein and having another extremity engageable with a stationary blade in said housing, said binding post and said blade forming respective terminals of said operating circuit, and a pusher member extending into said housing through an aperture adjoining said other extremity, said clockwork having a shaft provided with cam means engaging said pusher member for moving said other extremity into conductive contact with said blade in a predetermined position of said shaft.

32. A timepiece as defined in claim 31 wherein said blade is generally T-shaped with a stem anchored to a wall of said housing and with a transverse bar spaced from said wall, said aperture being provided in said wall, said other extremity being bifurcate and normally straddling said stem with clearance but being movable by said pressure member into engagement with said transverse bar.

33. A timepiece as defined in claim 31 or 32 wherein said housing is subdivided into two adjacent compartments respectively containing substantially identical leaf springs, binding posts and blades forming part of said switch means, each of said compartments being provided with an aperture traversed by a respective pusher member controlled by said cam means for establishing conductive contact between respective leaf springs and blades in different positions of said shaft.

* * * * *

UNITED STATES PATENT AND TRADEMARK OFFICE

CERTIFICATE OF CORRECTION

PATENT NO. : 4,482,260

DATED : November 13, 1984

INVENTOR(S) : Wolfgang Fehrenbacher

It is certified that error appears in the above-identified patent and that said Letters Patent is hereby corrected as shown below:

On the title page, left column, insert item [30] to read:

-- Foreign Application Priority Data

July 10, 1981 [DE] Fed. Rep. of Germany....81 20 168

October 6, 1981 [DE] Fed. Rep. of Germany....81 29 150

January 28, 1982 [DE] Fed. Rep. of Germany....82 02 017

April 10, 1982 [DE] Fed. Rep. of Germany....82 10 284

April 21, 1982 [DE] Fed. Rep. of Germany....82 11 361 --.

Signed and Sealed this

Thirtieth Day of April 1985

[SEAL]

*Attest:*

DONALD J. QUIGG

*Attesting Officer* *Acting Commissioner of Patents and Trademarks*